United States Patent [19]

Donck

[11] Patent Number: 5,005,794

[45] Date of Patent: Apr. 9, 1991

[54] DISPLAY STAND FOR A SHELL

[76] Inventor: Daniel G. J. Donck, Verbeekstraat 225, Overijse, Belgium

[21] Appl. No.: 484,927

[22] Filed: Feb. 23, 1990

[30] Foreign Application Priority Data

Mar. 8, 1989 [BE] Belgium ..... 08900250

[51] Int. Cl.[5] ..... A47B 91/00

[52] U.S. Cl. ..... 248/346; 428/71; 428/542.4

[58] Field of Search ..... 248/346, 176; 428/542.2, 542.4, 3, 71; 206/83, 486, 487

[56] References Cited

U.S. PATENT DOCUMENTS

| | | | |
|---|---|---|---|
| D. 246,348 | 11/1977 | Einhorn | 428/3 X |
| 1,771,271 | 7/1930 | Pommer | 248/158 |
| 2,269,780 | 1/1942 | Myerson | 206/83 |
| 2,684,820 | 7/1954 | Korn | 248/346 |
| 3,503,832 | 3/1970 | Umminger, Jr. | 428/542.2 X |
| 3,595,727 | 7/1971 | Allen | 248/176 |
| 4,597,550 | 7/1986 | Rice, Sr. | 248/346 X |

*Primary Examiner*—Gary L. Smith
*Assistant Examiner*—Michael J. Milano
*Attorney, Agent, or Firm*—Leonard Bloom

[57] ABSTRACT

The invention relates to a display stand (2) for a shell (1, 11) which comprises a pedestal having a plate (3, 13) pierced with at least one hole (6) and at least one structural element (4, 15) which raises said plate in relation to the support on which the display stand may be placed. The shell (1, 11) is secured in position by adhesive (8) which makes the lower surface of the plate (3, 13) solid with a small protuberant part (7) of the shell (1, 11) inserted in the hole (6) by bearing on the edges of said hole (6).

14 Claims, 1 Drawing Sheet

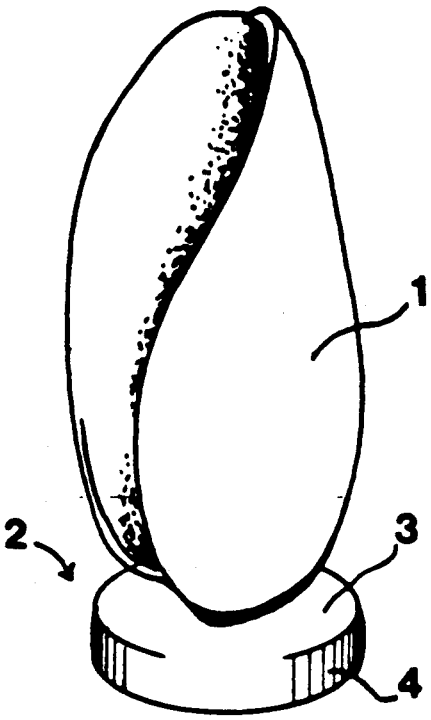
Fig 1
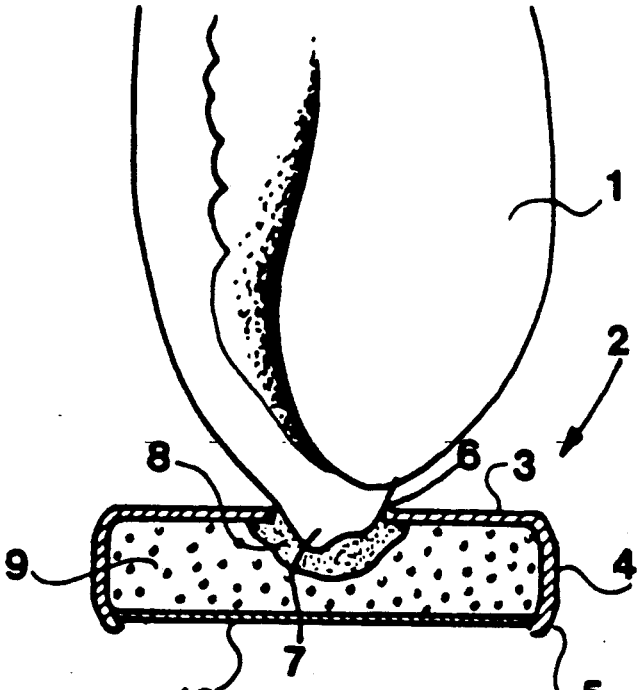
Fig 2
Fig 3
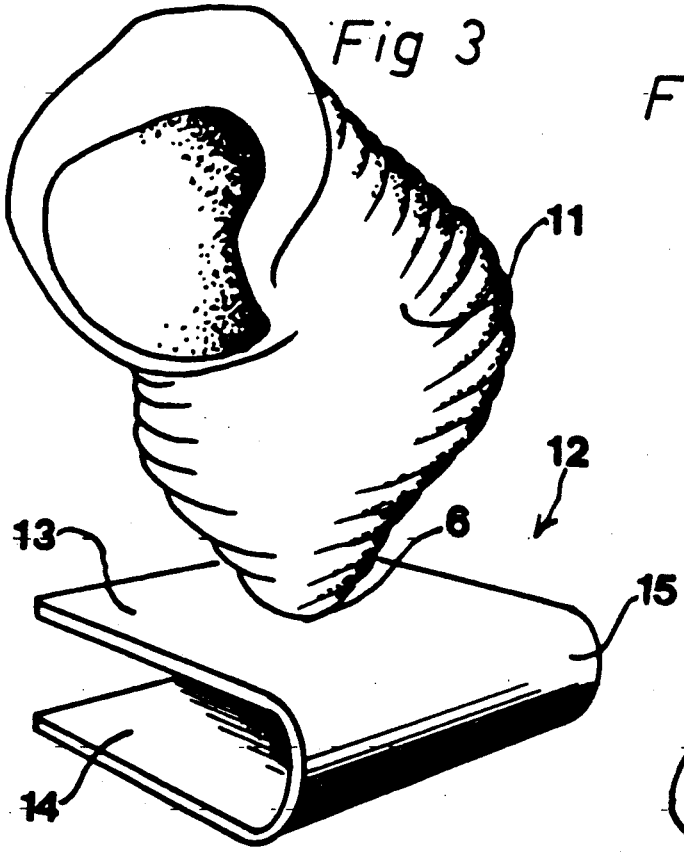
Fig 4
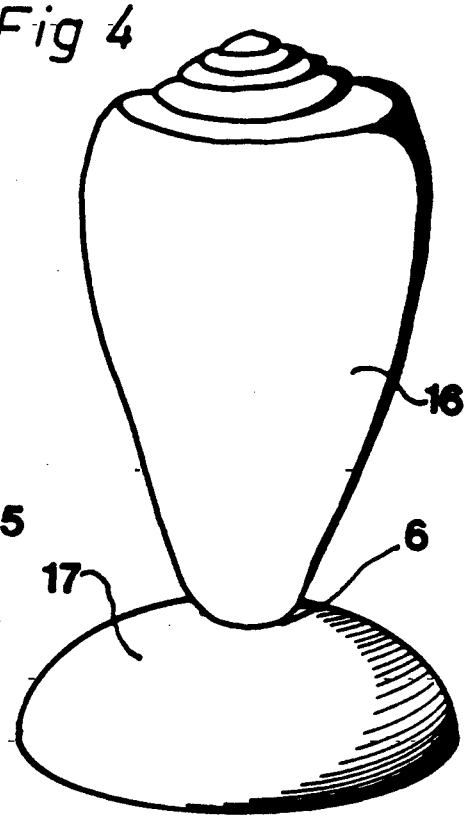

DISPLAY STAND FOR A SHELL

FIELD OF THE INVENTION

The present invention relates to a display stand for a shell. It relates, in particular, to a display stand of the "pedestal" type especially adapted for gastropods coiled about a central line known as the columella.

BACKGROUND OF THE INVENTION

Throughout time, man has collected shells in nature and has exhibited them as decorative articles. Some of them have a shape such that their aesthetic aspect (for example, the mother of pearl which adorns the inside of the shell) may be displayed, even when they are simply placed on a plane surface. Bivalves, for example, lend themselves very well to this type of simple presentation, and likewise ormers.

Many gastropods have a shell in the form of a cone, spirally coiled about a central line known as the columella. Murices are a particularly well-known example of this very widespread type of shell. They are more difficult to show to advantage because of their irregular form.

Several types of pedestal or other display stands to exhibit shells are already known.

Inter alia, display stands having metal wires which grip around certain parts of the shell and thus maintain it in a certain position in relation to the support are known. Very often, however, a technique of this type makes it impossible to exhibit the shell with an orientation which seems the most advantageous. Furthermore, the metal securing wires spoil the aesthetic appearance.

According to another technique, the shell is hung from a metal wire which is itself integral with a pedestal or another support. With this method, the shell is damaged since it is necessary to pierce it with at least one small hole to enable it to be attached to the wire. It will be understood that securing of this type is generally quite fragile.

A technique which makes it possible to exhibit a shell in any predetermined position consists in coating it completely in a transparent resin such as polymethyl methacrylate. This technique is not only expensive, but this presentation seems particularly artificial and furthermore makes the shell permanently inaccessible.

According to another technique, only a small part of the shell is coated in a block of resin which forms its pedestal. This technique is also difficult and expensive and, as sometimes presentation is not particularly aesthetic it may prove necessary to hide the block of resin inside another decorative article.

However, the most common type of display stand for a shell to date is a pedestal which consists of a solid block of wood or stone (for example, marble) on which the shell is secured by means of a small amount of adhesive. This type of securing of the shell on the display stand is not only fragile, in most cases, but also the shell can usually not be secured on the pedestal by one of its protuberances. Where—in order to increase the strength of the securing—the amount of adhesive is increased, said adhesive remains visible between the shell and its pedestal, which spoils the aesthetic appearance.

SUMMARY OF THE INVENTION

The object of the invention is to provide a display stand for a shell and, in particular, for gastropods, which shows said shells to advantage, without damaging them and without spoiling their natural appearance.

Another object of the invention is to provide a display stand of this type in the form of a pedestal, making it possible to secure thereto a shell with one of its protuberances facing downwards, while, at the same time, ensuring a strong and stable securing.

A further object of the invention is to provide a display stand of this type which is aesthetic while employing a technique which is simple, quick and economic to implement.

The display stand according to the invention is especially advantageous for shells such as those of gastropods (for example murices, cones, volutes, doliums, etc.) having one end closed in the form of a cone or rounded, from where the shell develops into a spiral up to its open end. The display stand according to the invention makes it possible, inter alia, to mount a shell of this type with said closed conical end facing downwards, the columella being oriented substantially vertically.

The invention relates to a display stand for a shell which comprises a pedestal having a plate pierced with at least one hole and at least one structural element which raises said plate in relation to the support on which the display stand may be placed. The shell is secured in position by adhesive which makes the lower surface of the plate solid with a small protuberant part of the shell which is inserted in said hole by bearing on the edges of said hole.

According to a preferred embodiment, the structural element which raises the plate in relation to the support on which the display stand may be placed is a downward edge of the periphery of the plate. Advantageously the lower part of said edge has a narrowing towards the center of the pedestal. Advantageously, a pellet of foam polymer fills the inside of the pedestal not occupied by the small protuberant part of the shell inserted in the hole and by the adhesive. Furthermore, the lower part of the pedestal is preferably closed by a semi-rigid insert inserted behind the narrowing of the lower part of the edge. Said insert may, for example, be constructed of cardboard or plastic material and may, in particular, be used to indicate the name of the shell.

According to a particular embodiment, said plate and, if appropriate, the whole pedestal, may be formed from metal, but other materials may also be used.

The plate, which is pierced with at least one hole, may be of circular, oval, rectangular or triangular shape.

The invention also relates to a method for constructing an assembly formed by a shell secured on a display stand according to the invention. To construct said assembly, the shell is arranged in the desired position in relation to the display stand by inserting a small protuberant part of the shell in the hole of the plate exhibited by said display stand, by bearing on the edge of said hole. The shell is then secured in position on the pedestal by applying adhesive on the side of the lower surface of said plate so as to make the latter solid with the small protuberant part of the shell inserted in the hole.

The adhesive used is preferably hot-melt adhesive which offers the advantage of being easily applied and hardening very rapidly.

According to a preferred embodiment, the pedestal comprises a plate pierced with a hole and provided, on its periphery, with downward edges, the lower part of said edges having a narrowing towards the center of the pedestal. In this case, after having secured the shell on the pedestal, it is advantageous to introduce through the bottom of the pedestal a pellet of foam polymer which fills the inside of the pedestal not occupied by the protuberant part of the shell inserted in the hole and by the adhesive. The display stand may then be completed by inserting a semi-rigid insert of an appropriate form and constructed of, for example, cardboard or plastic material behind the narrowing of the lower part of the edge.

Other special features and advantages of the invention will emerge from the description of embodiments described below with reference to the attached drawings.

BRIEF DESCRIPTION OF THE DRAWINGS

FIG. 1 shows a general perspective view of a shell mounted on a display stand according to the invention;

FIG. 2 shows a section of the assembly shown in FIG. 1, along a vertical plane passing through the center of the display stand, and FIGS. 3 and 4 are general perspective views of shells mounted on display stands according to the invention, which are examples of other embodiments.

DESCRIPTION OF PREFERRED EMBODIMENTS

FIGS. 1 and 2 show a shell 1 mounted on a display stand 2 which comprises a pedestal having a circular metal plate 3 provided with a downward edge 4. The lower part 5 of the edge 4 is inclined obliquely towards the center of the display stand 2, thus forming a narrowing of the lower opening of the latter.

The center of the plate 3 is pierced with a circular through hole 6, as can be seen by reference to FIG. 2. A small protuberant part 7 of the shell 1 is inserted in said hole 6 by bearing on its edges. Hot-melt adhesive 8 makes the lower surface of the plate 3 solid with said small protuberant part 7 of the shell 1.

A pellet 9, made of fairly flexible polyurethane foam fills the inside of the pedestal which is not occupied by the adhesive 8 and by the small protuberant part 7. A small insert 10 in the form of a disc and made of semi-rigid plastic material, is inserted behind the narrowing of the lower opening of the pedestal. Said small disc 10, which closes the lower part of the display stand 2 may bear information such as the name of the shell and the name of the firm marketing the article.

FIG. 3 shows another embodiment of the invention. A shell 11 is mounted on a display stand 12 formed from a metal plate folded into a U and thus assuming the appearance of a book cover. Said display stand 12 has therefore an upper plate 13 and a lower plate 14 connected to one another by a rounded part 15. The center of the upper plate 13 is pierced with a circular hole 6. A small protuberant part of the shell is inserted in said hole 6 by bearing on its edges. The shell 11 is secured in position on the display stand 12 in the same manner as for the display stand 2 of FIGS. 1 and 2.

FIG. 4 shows another embodiment of the invention. In this case, the shell is mounted on a display stand 17 which has substantially the form of a skull cap. The shell 16 is secured on the display stand 17 in the same manner as for the display stand 2 shown in FIGS. 1 and 2.

The display stand according to the invention permits not only a highly aesthetic presentation of the shell, but also enables the shell to be secured on the display stand in a highly stable manner. The securing method is very easy and quick because it is possible to use hot-melt adhesive; said adhesive is applied directly to the protuberant part of the shell which is inserted in the hole of the pedestal, which ensures excellent adherence. Because the shell bears on the edge of said hole and the adhesive is caused to overlap the lower surface of the plate of the pedestal, the mounting would remain stable even if the adhesion of the adhesive on said plate (constructed, for example, of smooth and bright metal) were poor or even non-existent.

The embodiments described above with reference to the drawings are non-limiting examples of the display stand according to the invention.

I claim:

1. A display stand for a shell, which, in combination, comprises a pedestal having a plate (3, 13) pierced with at least one through hole (6) and at least one structural element (4, 15) which raises said plate in relation to a support on which the display stand is placed, the shell (1, 11) being secured in position by adhesive (8) placed on a lower surface of the plate which makes the lower surface of said plate (3, 13) solid with a small protuberant part (7) of the shell (1, 11) inserted in said through hole (6) and bearing on an edge of the through hole (6).

2. The display stand as claimed in claim 1, wherein said plate (3, 13) is constructed of metal.

3. The display stand as claimed in claim 1, wherein the structural element (4, 15), which raises the plate (3) in relation to the support on which the display stand (2) may be placed, is a downward edge (4) of the periphery of the plate (3).

4. A display stand for a shell, which comprises a pedestal having a plate (3, 13) pierced with at least one through hole (6) and at least one structural element (4, 15) which raises said plate in relation to a support on which the display stand is placed, the shell (1, 11) being secured in position by adhesive (8) which makes a lower surface of said plate (3, 13) solid with a small protuberant part (7) of the shell (1, 11) inserted in said through hole (6) by bearing on an edge of the through hole (6), wherein the structural element (4, 15), which raises the plate (3) in relation to the support on which the display stand (2) is placed, is a downward edge (4) of the periphery of the plate (3), and wherein a lower part of the edge (4) has a narrowing towards the center of the pedestal.

5. The display stand as claimed in claim 4, wherein a pellet (9) of foam polymer fills the inside of the pedestal not occupied by the small protuberant part (7) of the shell (1, 13) inserted in the hole (6) and by the adhesive (8).

6. The display stand as claimed in claim 5, wherein the lower part of the pedestal is closed by a semi-rigid insert (10) inserted behind the narrowing of the lower part of the edge (4).

7. The display stand as claimed in claim 6, wherein said insert is constructed of a material selected from cardboard and plastic materials.

8. The display stand as claimed in claim 1, wherein said adhesive (8) is a hot-melt adhesive.

9. The display stand as claimed in claim 1, wherein the plate (3, 13) may be of circular, oval, or rectangular shape.

10. The display stand as claimed in claim 9, wherein the plate (3) is circular.

11. A method for constructing an assembly formed by a shell (1, 11, 16) secured on a display stand (2, 12, 17), wherein the shell (1, 11, 16) is arranged in the desired position in relation to the display stand (2, 12, 17) which, in combination, comprises a pedestal having a plate (3, 13) pierced with at least one through hole (6) having an edge and at least one structural element (4, 15) which raises said plate (3, 13) in relation to a support on which the display stand (2, 12, 17) is placed, a small protuberant part (7) of the shell (1) being inserted in said through hole (6) and bearing on the edge of said through hole (6), and wherein the shell (1, 11, 16) is secured in position on the pedestal by applying adhesive (8) to a lower surface of the plate so as to make a lower surface of said plate (3, 13) solid with the small protuberant part (7) of the shell (1, 11, 16) inserted in said through hole (6).

12. The method as claimed in claim 11, wherein said adhesive (8) is a hot-melt adhesive.

13. A method for constructing an assembly formed by a shell (1, 11, 16) secured on a display stand (2, 12, 17), wherein the shell (1, 11, 16) is arranged in the desired position in relation to the display stand (2, 12, 17) which comprises a pedestal having a plate (3, 13) pierced with at least one through hole (6) having an edge, and at least one structural element (4, 15) which raises said plate (3, 13) in relation to a support on which the display stand (2, 12, 17) is placed, a small protuberant part (7) of the shell (1) being inserted in said through hole (6) by bearing on the edge of said through hole (6), and wherein the shell (1, 11, 16) is secured in position on the pedestal by applying adhesive (8) so as to make a lower surface of said plate (3, 13) solid with the small protuberant part (7) of the shell (1, 11, 16) inserted in said through hole (6), wherein said adhesive is a hot-melt adhesive, and wherein the structural element which raises the plate (3) in relation to the support on which the display stand (2) is placed, is a downward edge (4) of the periphery of the plate (3), a lower part of the edge (4) having a narrowing towards the center of the pedestal.

14. The method as claimed in claim 13, wherein, after having secured the shell (1) on the pedestal, a pellet (9) of foam polymer is introduced through the bottom of the pedestal, which pellet (9) fills the inside of the pedestal not occupied by the protuberant part (7) of the shell (1) inserted in the hole (6) and by the adhesive (8) and, subsequently, a semi-rigid insert (10) constructed of a material selected from cardboard and plastic materials, is inserted behind the narrowing of the lower part of the edge.

* * * * *